US007118423B2

(12) United States Patent
Kobayashi et al.

(10) Patent No.: US 7,118,423 B2
(45) Date of Patent: Oct. 10, 2006

(54) JOINT CONNECTOR STRUCTURE

(75) Inventors: Toru Kobayashi, Haibara-gun (JP); Hideki Ohsumi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/137,387

(22) Filed: May 26, 2005

(65) Prior Publication Data

US 2005/0266731 A1 Dec. 1, 2005

(30) Foreign Application Priority Data

May 31, 2004 (JP) ..... P2004-161868

(51) Int. Cl.
*H01R 13/10* (2006.01)
*H01R 25/00* (2006.01)

(52) U.S. Cl. ..... 439/682; 439/638; 439/908; 439/723

(58) Field of Classification Search ..... 439/638, 439/682, 908, 212, 721–724, 949, 271, 509, 439/513

See application file for complete search history.

(56) References Cited

U.S. PATENT DOCUMENTS 5,201,667 A * 4/1993 Endo et al. ..... 439/511
5,562,502 A * 10/1996 Kourimsky ..... 439/621
5,738,549 A * 4/1998 Laquerbe ..... 439/724
6,186,832 B1 * 2/2001 Madden et al. ..... 439/638
6,368,131 B1 * 4/2002 Takeuchi et al. ..... 439/271
6,494,722 B1 * 12/2002 Sakamoto et al. ..... 439/76.2

FOREIGN PATENT DOCUMENTS

JP 11-54229 A 2/1999

* cited by examiner

*Primary Examiner*—Tho D. Ta
(74) *Attorney, Agent, or Firm*—Sughrue Mion, PLLC

(57) ABSTRACT

A first connector includes a joint bus bar mounted in a first housing, and wire-connected first female terminals inserted respectively in terminal receiving chambers to be connected respectively to tabs of the joint bus bar. A second connector includes wire-connected second female terminals inserted respectively in terminal receiving chambers in a second housing. When the first connector and the second connector are fitted together in such a manner that the second connector is inserted into a connector fitting portion, the wire-connected second female terminals of the second connector are connected respectively to tabs of the joint bus bar.

9 Claims, 3 Drawing Sheets

JOINT CONNECTOR STRUCTURE

BACKGROUND OF THE INVENTION

This invention relates to a joint connector structure for joining desired wires together by the use of connectors.

One known related joint connector structure is disclosed in the following Patent Literature 1. The joint connector structure of the undermentioned Patent Literature 1 comprises a first connector 2 having a plurality of wire-connected first female terminals 1, a second connector 4 having a plurality of wire-connected second female terminals 3, and a common connector 6 having a common terminal 5, and the first connector 2 and the second connector 4 are fitted into the common connector 6 respectively in opposite directions, so that the wire-connected first female terminals 1 and the wire-connected second female terminals 3 are connected together by the common terminal 5. Electrical connection between the wire-connected first female terminals 1, electrical connection between the wire-connected second female terminals 3, and electrical connection between the wire-connected first female terminals 1 and the wire-connected second female terminals 3 are made through the common terminal 5.

Patent Literature 1: JP-A-11-54229 (Page 3, FIGS. 1 to 2)

The structure of the above related technique comprises the three connectors, that is, the first connector 2, the second connector 4 and the common connector 6, and therefore the number of the steps of the production process, as well as the number of the component parts, is relatively large. And besides, in the joining operation, the fitting connection between the first connector 2 and the common connector 6 and the fitting connection between the second connector 4 and the common connector 6 need to be carried out.

SUMMARY OF THE INVENTION

This invention has been made in view of the above circumstances, and an object of the invention is to provide a joint connector structure which can reduce the number of component parts, and also can enhance the efficiency of the production and the efficiency of the operation.

In order to accomplish the above object, a joint connector structure of the present invention is characterized by having the following arrangement:

(1) A joint connector structure comprising:
- a first connector that comprises:
  - a first housing that has a connector fitting portion at one end of the first housing, and a first terminal receiving portion at the other end of the first housing;
  - a joint bus bar that is mounted in the first housing, and is provided with a first tab projecting into the connector fitting portion at one end of the joint bus bar, and a second tab projecting into the first terminal receiving portion at the other end of the joint bus bar, and
  - a wire-connected first female terminal that is connected to a first wire, is inserted in the first terminal receiving portion, and is connected to the first tab; and
- a second connector that comprises:
  - a second housing that has a second terminal receiving portion; and
  - a wire-connected second female terminal that is connected to a second wire, and is inserted in the second terminal receiving portion, wherein
- when the first connector and the second connector are fitted together in such a manner that the second connector is inserted into the connector fitting portion, the wire-connected second female terminal is connected to the second tab.

(2) A joint connector structure according to (1), wherein each of the wire-connected first and second female terminals is provided with a waterproof rubber plug.

(3) A joint connector structure according to (2), wherein
- the first housing has a first open end, into which the first wire is inserted, at the first terminal receiving portion,
- the second housing has a second open end, into which the second wire is inserted, at the second terminal receiving portion, and
- the water proof rubber plugs occupy the first and second open ends, respectively.

(4) A joint connector structure according to (1), wherein the connector fitting portion is provided with a packing.

(5) A joint connector structure according to (4), wherein
- the connector fitting portion has a side wall and an inner wall, into which the joint bus bar is inserted, and
- the packing is disposed at a boundary portion between the side wall and the inner wall.

(6) A joint connector structure according to (1), wherein
- the joint bus bar comprises a plurality of the first and second tabs,
- the first connector comprises a plurality of the wire-connected first female terminals corresponding to the first tabs, and
- the second connector comprises a plurality of the wire-connected second female terminals corresponding to the second tabs.

In the invention having these features, desired wires of a wire harness are joined together by the two connectors. In the invention, there are used the first and second connectors, and this first connector functions both as a connector and as a joint connector. When the first and second connectors are fitted together, the joining connection between the wire-connected first female terminals, the joining connection between the wire-connected second female-terminals, and the joining connection between the wire-connected first female terminals and the wire-connected second female terminals are completed.

In the invention, there is achieved an advantage that there is provided the joint connector structure in which as compared with the related structure, the number of the component parts can be reduced, and also the efficiency of the production as well as the efficiency of the operation can be enhanced.

In the invention, there is achieved an advantage that the joint connector structure has the waterproof ability.

BRIEF DESCRIPTION OF THE DRAWINGS

FIG. 1A is a cross-sectional view showing a connector-fitted condition, and FIG. 1B is a cross-sectional view showing a condition before the connector-fitted condition is achieved.

DETAIL DESCRIPTION OF PREFERRED EMBODIMENTS

The present invention will now be described with reference to the drawings.

Figure 1A:
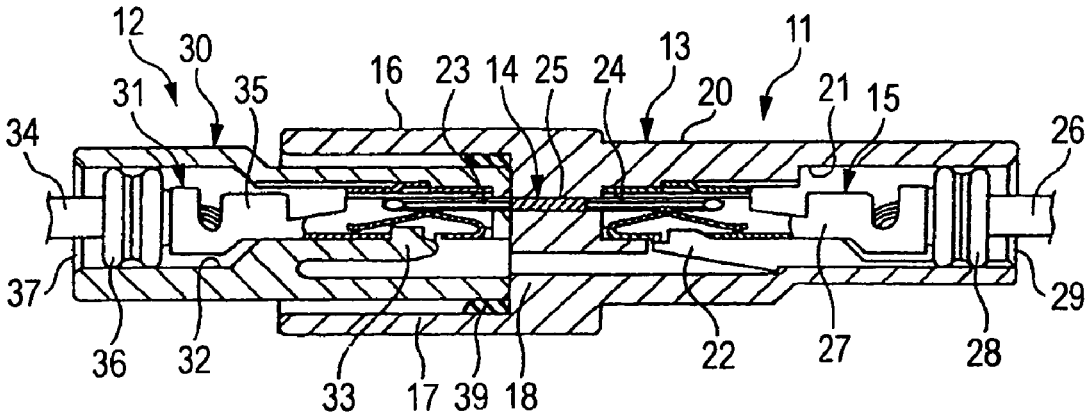
FIGS. 1A and 1B are views showing one preferred embodiment of a joint connector structure of the present invention.
Figure 1B:
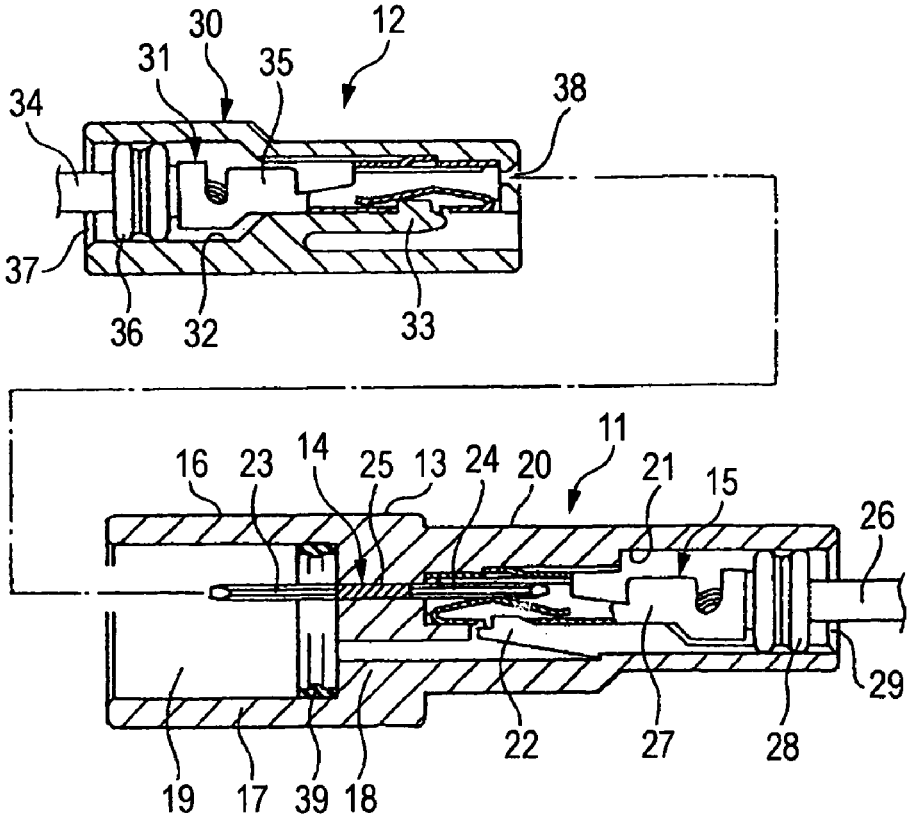
Figure 2:
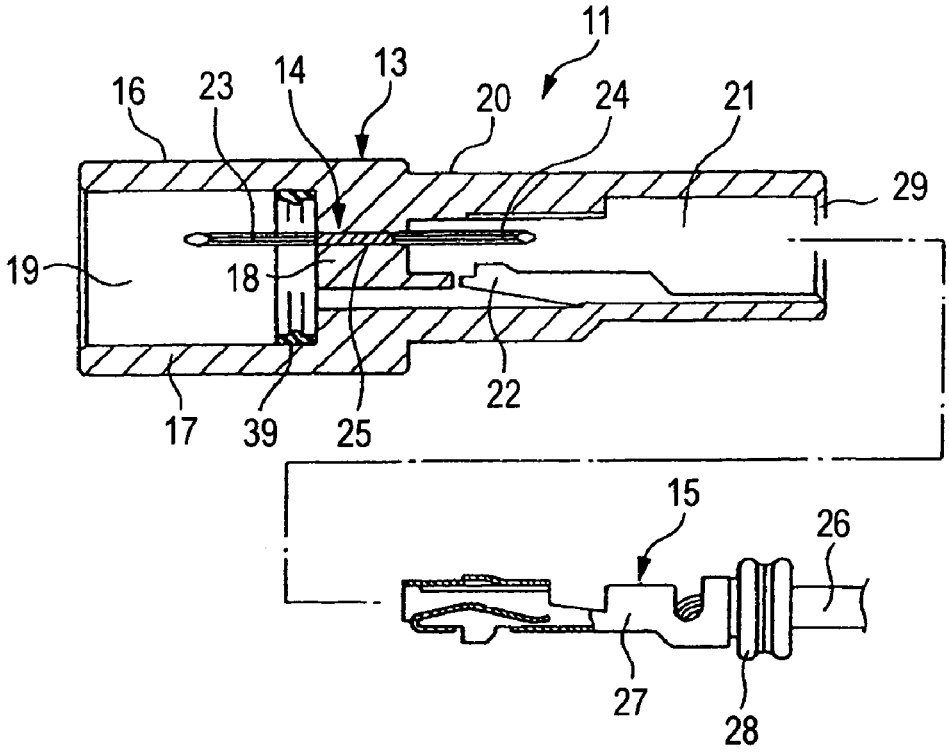
FIG. 2 is a view explanatory of the construction of a first connector.

FIGS. 1A and 1B are views showing one preferred embodiment of a joint connector structure of the invention, and FIG. 1A is a cross-sectional view showing a connector-fitted condition, and FIG. 1B is a cross-sectional view showing a condition before the connector-fitted condition is achieved. FIG. 2 is a view explanatory of the construction of a first connector, and FIG. 3 is a view explanatory of the construction of a second connector.

Figure 3:
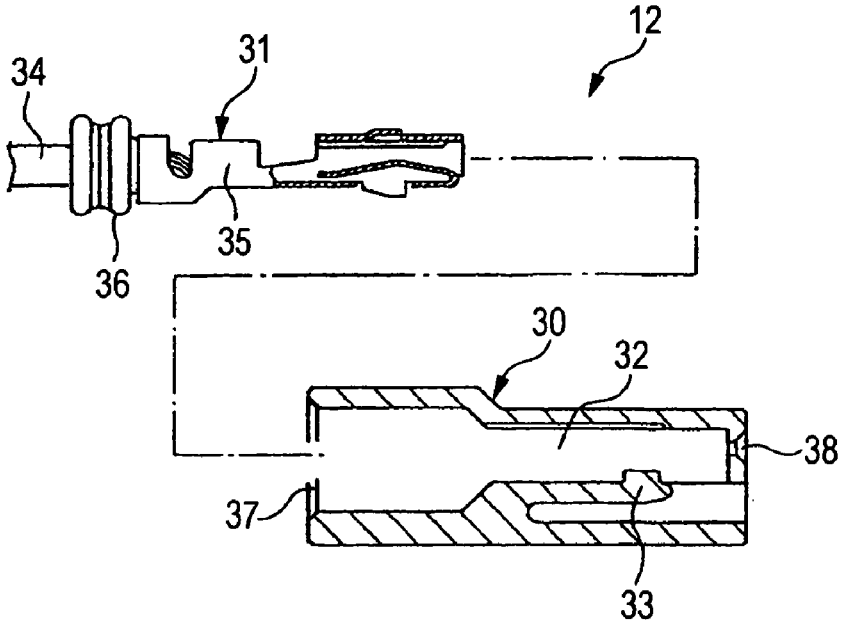
FIG. 3 is a view explanatory of the construction of a second connector.
Figure 4:
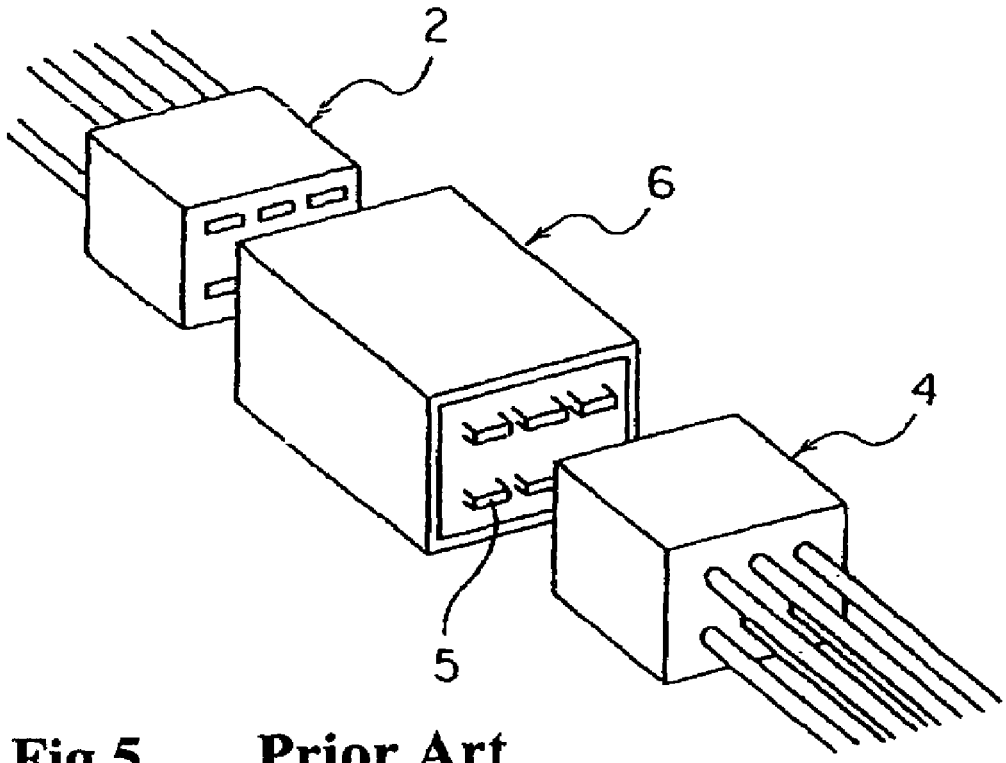
Fig 4 Prior Art
FIG. 4 is an exploded, perspective view showing a related joint connector structure.
Figure 5:
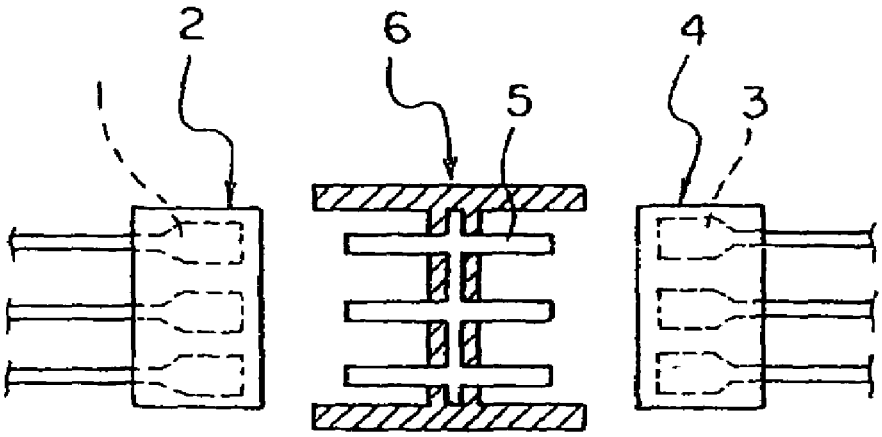
Fig 5 Prior Art
FIG. 5 is a cross-sectional view of the joint connector structure of FIG. 4.

In FIGS. 1 to 3, the joint connector structure of the invention comprises the two connectors, that is, the first connector 11 and the second connector 12. Each of the constituent members will be described below.

The first connector 11 comprises a first housing 13 made of an insulative synthetic resin, a joint bus bar 14 made of electrically-conductive metal, and a plurality of wire-connected first female terminals 15. The first connector 11 functions both as a connector and as a joint connector.

The first housing 13 includes a box-like connector fitting portion 16. The connector fitting portion 16 is formed into such a shape that the first housing 13 has an open front side. This connector fitting portion 16 includes a plurality of side walls 17, an inner wall 18, and a fitting space 19. The connector fitting portion 16 serves as a portion into which the second connector 12 can be fitted. Although not particularly shown in the drawings, a first lock portion for retaining the second connector 12 is formed at the connector fitting portion 16. A packing 39 is mounted within the connector fitting portion 16. The packing 39 serves to add a waterproof structure to the first connector 11, and is mounted within the fitting space 19, and is disposed at a boundary portion between each side wall 17 and the inner wall 18. In the case where it is not necessary to add such a waterproof structure, the provision of the packing 39 is not necessary.

A terminal receiving portion 20 is formed to extend from the connector fitting portion 16. The terminal receiving portion 20 has a box-shape, and extends rearwardly from the inner wall 18 of the first housing 13. A plurality of terminal receiving chambers 21 are formed within the terminal receiving portion 20. The plurality of terminal receiving chambers 21 are arranged in a row in a horizontal direction. Each of the terminal receiving chambers 21 is formed into such a shape that the wire-connected first female terminal 15 can be inserted thereinto. A lance 22 for retaining the wire-connected first female terminal 15 is formed within each terminal receiving chamber 21.

The joint bus bar 14 includes a plurality of tabs 23 projecting into the fitting space 19 of the connector fitting portion 16, a plurality of tabs 24 projecting respectively into the terminal receiving chambers 21 of the terminal receiving portion 20, and a strip-like interconnecting portion 25 interconnecting the tabs 23 and the tabs 24. At least the interconnecting portion 25 of the joint bus bar 14 is fixed to the inner wall 18 of the first housing 13. One example of methods of fixing the joint bus bar is a method in which retaining projections are formed on the interconnecting portion, and this interconnecting portion is press-fitted into a hole formed in the inner wall 18.

Each of the wire-connected first female terminals 15 comprises a wire 26 which forms, together with other wires, a wire harness (not shown), and a female terminal 27 connected to an end portion of the wire 26. The female terminal 27 includes a wire connection portion for the connection of the wire 26 thereto, and a box-like electrical contact portion. A resilient contact piece portion for contact with the tab 24 of the joint bus bar 14 is formed at the electrical contact portion. Further, a recess for retaining engagement with the lance 22 of the first housing 13 is formed in the electrical contact portion.

In this embodiment, the wire-connected first female terminal 15 has a rubber plug 28. This rubber plug 28 adds a waterproof structure to the first connector 11, and is disposed in the terminal receiving chamber 21 in such a manner occupying a terminal insertion opening 29 formed in a rear end of the first housing 13 in order to prevent water and moisture from intruding into the terminal receiving chamber 21 from the exterior. In the case where it is not necessary to add such a waterproof structure, the provision of the rubber plug 28 is not necessary.

The wire-connected first female terminal 15 is inserted into the terminal receiving chamber 21 through the terminal insertion opening 29. The first female terminal 15, thus inserted into the terminal receiving chamber 21, is retained by the lance 22.

The second connector 12 comprises a second housing 30 made of an insulative synthetic resin, and a plurality of wire-connected second female terminals 31. The second housing 30 is formed into such a box-shape that it can be inserted into the connector fitting portion 16 of the first housing 13. A second lock portion (not shown) for retaining engagement with the first lock portion of the first housing 13 is formed on an outer surface of the second housing 30. A plurality of terminal receiving chambers 32 are formed within the second housing 30.

The plurality of terminal receiving chambers 32 are arranged in a row in the horizontal direction. Each terminal receiving chamber 32 is formed into such a shape that the wire-connected second female terminal 31 can be inserted thereinto. A lance 33 for retaining the wire-connected second female terminal 31 is formed within each terminal receiving chamber 32.

Each of the wire-connected second female terminals 31 comprises a wire 34 which forms, together with other wires, a wire harness (not shown), and a female terminal 35 connected to an end portion of the wire 34. The female terminal 35 includes a wire connection portion for the connection of the wire 34 thereto, and a box-like electrical contact portion. A resilient contact piece portion for contact with the tab 23 of the joint bus bar 14 is formed at the electrical contact portion. Further, a recess for retaining engagement with the lance 33 of the second housing 30 is formed in the electrical contact portion. The wire-connected second female terminals 31, used in this embodiment, have the same construction as that of the wire-connected first female terminals 15 although the second female terminals 31 are not particularly limited to this construction.

In this embodiment, the wire-connected second female terminal 31 has a rubber plug 36 in such the same manner of the wire-connected first female terminal 15. This rubber plug 36 adds a waterproof structure to the second connector 12, and prevents water and moisture from intruding into the terminal receiving chamber 32 from the exterior. In the case where it is not necessary to add such a waterproof structure, the provision of the rubber plug 36 is not necessary.

The wire-connected second female terminal 31 is inserted into the terminal receiving chamber 32 through a terminal insertion opening 37 formed in a rear end surface of the second housing 30. The second female terminal 31, thus inserted into the terminal receiving chamber 32, is retained by the lance 33. The tabs 23 of the first connector 11 can be inserted respectively into the wire-connected second female terminals 31 through respective openings 38 formed in a front end surface of the second housing 30.

In the above construction, the first connector 11 is formed or assembled by inserting the wire-connected first female terminals 15 respectively into the corresponding terminal receiving chambers 21 in the first housing 13 having the joint bus bar 14 mounted therein. When each of the wire-connected first female terminals 15 is inserted into the terminal receiving chamber 21, the wire-connected first terminal 15 is retained by the lance 22 as described above. Also, the tabs 24 of the joint bus bar 14 are inserted respectively into the wire-connected first female terminals 15 when these first female terminals 15 are inserted into the respective terminal receiving chambers 21. As a result, the wire-connected first female terminals 15 are completely joined or connected together.

On the other hand, the second connector 12 is formed or assembled by inserting the wire-connected second female terminals 31 respectively into the corresponding terminal receiving chambers 32 in the second housing 30. When each of the wire-connected second female terminals 31 is inserted into the terminal receiving chamber 32, the wire-connected second female terminal 31 is retained by the lance 33 as described above.

The thus assembled first and second connectors 11 and 12 are located to be opposed to each other, and then when the second connector 12 is inserted into the connector fitting portion 16 of the first connector 11, thereby fitting the two connectors together, the wire-connected second female terminals 31 of the second connector 12 are connected respectively to the corresponding tabs 23 of the joint bus bar 14 of the first connector 11, and as the same time the first lock portion of the first housing 13 is retainingly engaged with the second lock portion of the second housing 30. As a result, the joining connection between the wire-connected second female terminals 31, as well as the joining connection between the wire-connected first female terminals 15 and the wire-connected second female terminals 31, is completed, thus completing the series of operations.

As described above with reference to FIGS. 1 to 3, with the joint connector structure of the invention, the desired wires of the wire harness can be joined together by the two connectors. Therefore, as compared with the related structure, the number of the component parts can be reduced, and also the efficiency of the production as well as the efficiency of the operation can be enhanced.

In the invention, various modifications can be made without departing from the subject matter of the invention. For example, in the above embodiment, although the terminals are arranged in one row in the horizontal direction, the invention is not limited to such arrangement, and the terminals can be arranged in a row in a vertical direction.

What is claimed is:

1. A joint connector structure comprising:

a first connector that comprises:

a one-piece integrally constructed first housing that has a connector fitting portion at one end of the first housing, and a first terminal receiving portion at the other end of the first housing, and an inner wall arranged between the connector fitting portion and the first terminal receiving portion;

a joint bus bar that is fixed to the inner wall of the first housing, and is provided with a first tab projecting into the connector fitting portion at one end of the joint bus bar, and a second tab projecting into the first terminal receiving portion at the other end of the joint bus bar, and a wire-connected first female terminal that is connected to a first wire, is inserted in the first terminal receiving portion, and is connected to the second tab; and a second connector that comprises:

a second housing that has a second terminal receiving portion; and a wire-connected second female terminal that is connected to a second wire, and is inserted in the second terminal receiving portion, wherein when the first connector and the second connector are fitted together in such a manner that the second connector is inserted into the connector fitting portion, the wire-connected second female terminal is connected to the first tab;

wherein the joint bus bar comprises a plurality of the first and second tabs, the first connector comprises a plurality of the wire-connected first female terminals corresponding to the first tabs, and the second connector comprises a plurality of the wire-connected second female terminals corresponding to the second tabs.

2. A joint connector structure according to claim 1, wherein the second housing is one-piece integrally constructed.

3. A joint connector structure according to claim 1, wherein the inner wall of the first housing faces a longitudinal axis of the first housing.

4. A joint connector structure according to claim 1, wherein each of the wire-connected first and second female terminals is provided with a waterproof rubber plug.

5. A joint connector structure according to claim 4, wherein the first housing has a first open end, into which the first wire is inserted, at the first terminal receiving portion, the second housing has a second open end, into which the second wire is inserted, at the second terminal receiving portion, and the water proof rubber plugs occupy the first and second open ends, respectively.

6. A joint connector structure according to claim 1, wherein the connector fitting portion is provided with a packing.

7. A joint connector structure according to claim 6, wherein the connector fitting portion has a side wall and an inner wall, into which the joint bus bar is inserted, and the packing is disposed at a boundary portion between the side wall and the inner wall.

8. A joint connector structure according to claim 1, wherein the joint bus bar further comprises an interconnecting portion and the interconnecting portion is fixed to the inner wall of the first housing.

9. A joint connector structure according to claim 8, wherein the interconnecting portion comprises retaining projections which are press fitted into a hole formed in the inner wall of the first housing.

* * * * *